United States Patent [19]

Hosoi

[11] Patent Number: 4,856,464

[45] Date of Patent: Aug. 15, 1989

[54] AIR DISTRIBUTION APPARATUS FOR USE WITH AN INTERNAL COMBUSTION ENGINE

[75] Inventor: Keiji Hosoi, Hamamatsu, Japan

[73] Assignee: Suzuki Jidosha Kogyo Kabushiki Kaisha, Shizuoka, Japan

[21] Appl. No.: 256,728

[22] Filed: Oct. 12, 1988

[30] Foreign Application Priority Data

Oct. 20, 1987 [JP] Japan ..... 62-159291

[51] Int. Cl.[4] ..... F02M 35/00

[52] U.S. Cl. ..... 123/52 M; 123/52 MC

[58] Field of Search ..... 123/52 M, 52 MV, 52 MC, 123/52 MB

[56] References Cited

U.S. PATENT DOCUMENTS

| | | | |
|---|---|---|---|
| 2,640,471 | 6/1953 | Haltenberger | 123/52 MV |
| 2,759,462 | 8/1956 | Haltenberger | 123/52 MV |
| 3,931,811 | 1/1976 | McFarland | 123/52 M |
| 4,256,063 | 3/1981 | Sumiyoshi et al. | 123/52 M |

FOREIGN PATENT DOCUMENTS

| | | | |
|---|---|---|---|
| 494681 | 7/1950 | France | 123/52 M |

*Primary Examiner*—David A. Okonsky

*Attorney, Agent, or Firm*—Flynn, Thiel, Boutell & Tanis

[57] ABSTRACT

An air-distribution apparatus for use with an internal combustion engine, wherein end portions of a plurality of branched air-intake tubes are respectively connected to air-intake holes of respective cylinders of a multiple-cylinder engine. A multiple-barrel carburetor is connected above a mounting assembly unit installed substantially at the center of the plurality of branched air-intake tubes so that each barrel communicates with the intake tubes through a respective air-intake port formed in the top wall of the mounting unit. A primary barrel of the carburetor is disposed in alignment with a transverse centerline of the mounting unit, and a secondary barrel of the carburetor is disposed in a position wherein it is displaced sidewardly from the centerline in the direction of the fuel nozzle tubes which connect to both barrels of the carburetor so as to permit more proper balancing of the air and fuel ratio as supplied to each cylinder.

7 Claims, 2 Drawing Sheets

AIR DISTRIBUTION APPARATUS FOR USE WITH AN INTERNAL COMBUSTION ENGINE

FIELD OF THE INVENTION

The present invention relates to an air-distribution apparatus for use with an internal combustion engine.

BACKGROUND OF THE INVENTION

A conventional multiple-cylinder internal combustion engine feeds fresh air to each cylinder through a carburetor by means of mechanism which provides connection of tip portions of a plurality of branched air intake tubes to an air-intake hole of each cylinder, and also connection of the carburetor to an inlet in the center of the assembly of air-intake tubes. A conventional carburetor is provided with primary and secondary barrels. Of these, the secondary barrel opens as soon as the vehicle reaches a certain speed faster than medium speed. As shown in FIG. 5, the conventional primary and secondary barrels are respectively provided with a small venturi B inwardly above a large venturi A. Fuel nozzle C opens into the venturi B, and its fuel supply tube D, by which it is connected to the float chamber E, extends radially partially across the large venturi A. As a result, air resistance increases in such region where the fuel tube D traverses, thus causing air-flow velocity V2 downstream thereof to be slower than air-flow velocity V1 which is present in such region where the fuel tube D does not traverse. This is turn causes more volume of fuel to flow through the portion of the carburetor barrel where air-flow velocity V1 is present, and thus resulting in an increased rate of fuel against air in the barrel portion where V1 is present. Even though the carburetor is mounted by an assembly unit provided at the center of a plurality of branched air-intake tubes, the ratio of fuel inside the cylinders supplied by V1 increases to eventually generate uneven fuel concentration between cylinders. This adversely affects the startup performance, driving comfortability without knocking, exhaust-gas control characteristic, and power-output characteristic of the vehicle itself.

To prevent those adverse effects mentioned above, Japanese Utility Model Publication No. 56-24305 (1981) and Japanese Utility Model Laid-Open No. 55-23458 (1980) have proposed use of modified multiple air-intake tubes. However, both of these systems require complex constitution of multiple air-intake tubes, and both require a variety of casting processes.

The primary objection of the invention is to provide a novel air distribution apparatus for use with an internal combustion engine, which securely generates exceeding performance of the engine by easily and properly balancing the ratio of air against fuel in the air-intake port of every cylinder by effectively displacing the position of carburetor connection to the assembly of multiple air-intake tubes.

BRIEF DESCRIPTION OF THE DRAWINGS

FIGS. 1 through 5 respectively represent a preferred embodiment of the invention wherein:

FIG. 1 is the plan of the air-distribution apparatus related to the invention;

FIG. 2 is the enlarged view of the essential constituents of the air distribution apparatus related to the invention;

FIG. 3 is the vertical sectional view of the essential constituents shown in FIG. 2 taken along line III—III;

FIG. 4 is the graphical chart denoting uneven mix ratio of air and fuel between cylinders according to the position of the carburetor; and FIG. 5 is the vertical sectional view of the venturi of a conventional carburetor.

DETAILED DESCRIPTION

Figure 1:
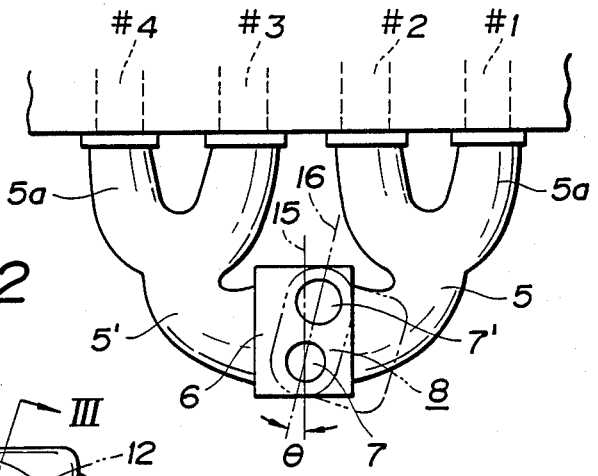
Figure 2:
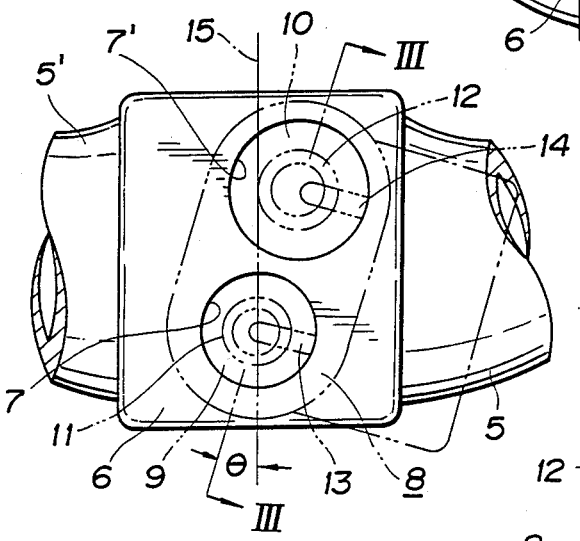
Figure 3:
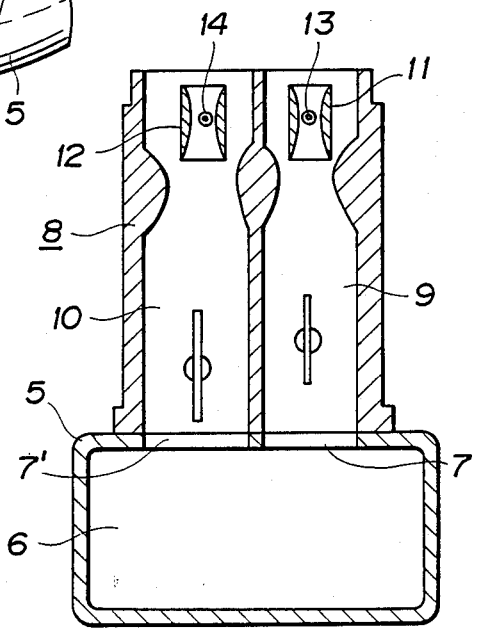

FIGS. 1 through 3 illustrate the application of the air-distribution apparatus to a four-cylinder engine. The air-intake manifold includes a plurality of branched air-intake tubes 5 and 5' having tip portions which are respectively connected to air-intake tubes 1 through 4 as provided in the cylinder head member for connection to the four cylinders. An assembly unit 6 is provided substantially at the center of these branched air-intake tubes 5 and 5' for mounting of a carburetor 8. The air-intake tubes 5 and 5' project generally in opposite directions from the assembly 6, one to the left and one to the right, while each of these discrete tubes 5 and 5' is split into two branches 5*a* at the ends thereof as shown in FIG. 1 to allow each of the branches 5*a* to be connected to one of the air-intake holes 1 through 4. A pair of air-intake ports 7 and 7' are provided in the upper surface of the assembly 6, whereby these air-intake ports directly communicate with the carburetor 8. Carburetor 8 is provided with primary barrel 9 and secondary barrel 10 for communication with ports 7 and 7' respectively.

The barrels 9 and 10 of the carburetor are disposed closely adjacent one another and, as is conventional, have respective small venturis 11 and 12 positioned centrally therein. These venturis 11 and 12, in a conventional manner, have fuel nozzles therein, which fuel nozzles are supplied by respective fuel supply tubes 13 and 14 which project radially outwardly from the sidewall of the respective barrel across the substantially one-half the barrel cross section for communication with the respective venturi. These fuel supply nozzles tubes 13 and 14 both project outwardly from generally the same side of the carburetor so as to extend in approximately parallel relationship.

The mounting assembly 6 is disposed substantially at the center of the air-intake manifold, as defined by the assembly 6 and tubes 5 and 5'. This assembly 6 defines a transversely extending centerline or plane 15, with the intake tubes 5 and 5' projecting outwardly away from opposite sides of this plane 15. The air passages defined from this plane 15 through the tubes 5 and 5' to the respective cylinders 1–4 are of equal length.

Figure 5:
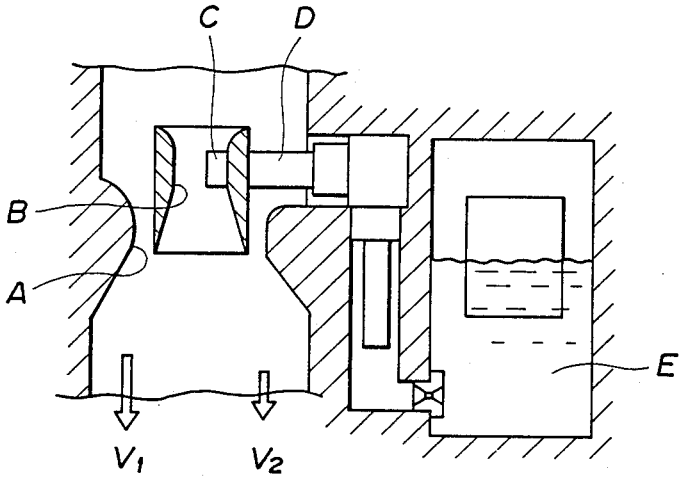
FIG. 5 PRIOR ART

The air-intake port 7 which opens through the top surface of the assembly 6 for communication with the air-intake tubes is positioned with its axial centerline disposed substantially within this transverse plane 15, and the carburetor barrel 9 thus also has its discharge end disposed with its axis substantially within this central plane 15. The fuel supply tube 13 associated with the barrel 9 projects radially across one side of the barrel, whereby this tube 13 is disposed dominantly on one side of the plane 15, namely on the right side as illustrated in FIG. 2. Because of the presence of this fuel supply tube 13, and the differential velocities V1 and V2 flowing through the barrel 9 in the manner illustrated by FIG. 5, a slightly greater quantity of fuel is supplied into the manifold on the left side of the plane 15 then on the right side thereof, and hence a slightly greater quantity of fuel will be supplied to the cylinders 3 and 4 then is supplied to the cylinders 1 and 2.

To at least partially compensate for the above, the secondary carburetor barrel 10 is secured to the mounting assembly 6 by being slightly displaced to one side of the central plane 15, namely to the rightward side as illustrated in FIGS. 1 and 2.

More specifically, the barrels 9 and 10 and their respective intake openings 7 and 7' are disposed in generally adjacent but transverse side-by-side relationship relative to the general flow direction through the intake 10 manifold. However, the intake 7' and its barrel 10 are not disposed with their axes within the central plane 15 as is true of the intake 7 and barrel 9, but rather the aligned axes of the intake 7' and barrel 10 are displaced to one side of the plane 15, namely the rightward side in FIG. 2. The axes of the intake 7' and barrel 10 are sidewardly displaced to the side of the plane 15 corresponding to the same side or direction of location of the fuel supply tubes 13 and 14 as associated with the barrels. The sideward displacement of this intake 7' and its barrel 10 is of such magnitude as to result in a great majority of the cross sectional area of the intake 7' being disposed on one side of the plane 15, although this plane still does normally intersect the opening 7' as illustrated by FIG. 2.

With this sideward placement of the opening 7' and barrel 10 relative to the central plane 15, this results in the defining of a further plane 16 which contains the axes of the openings 7 and 7' and the related respectively aligned axes of the barrels 9 and 10. This plane 16 intersects the plane 15 substantially at the aligned axes of the inlet 7 and barrel 9. These planes 15 and 16 define a small angle $\theta$ therebetween, which angle $\theta$ hence defines the small angle of tilt by which the carburetor is mounted relative to the central plane 15.

Due to this sideward displacement of the inlet 7' and its barrel 10, this results in a flow path from inlet 7' through tube 5' to intake holes 3 and 4 which is longer than the flow path from intake 7' through tube 5 to intake holes 1 and 2. This sideward displacement tends to partially compensate both for the differential velocity of flow which occurs through the right and left sides of the barrel 10 and also the differential flow which occurs between the right and left sides of the barrel 9, thereby achieving a more uniform and equalized supply of fuel to each of the air intake tubes 1 through 4. In particular, properly balanced mixed ratio between air and fuel as supplied to each cylinder generates optimal performance of the carburetor when the secondary barrel 10 opens to allow the vehicle to run at a speed faster than minimum speed.

Figure 4:
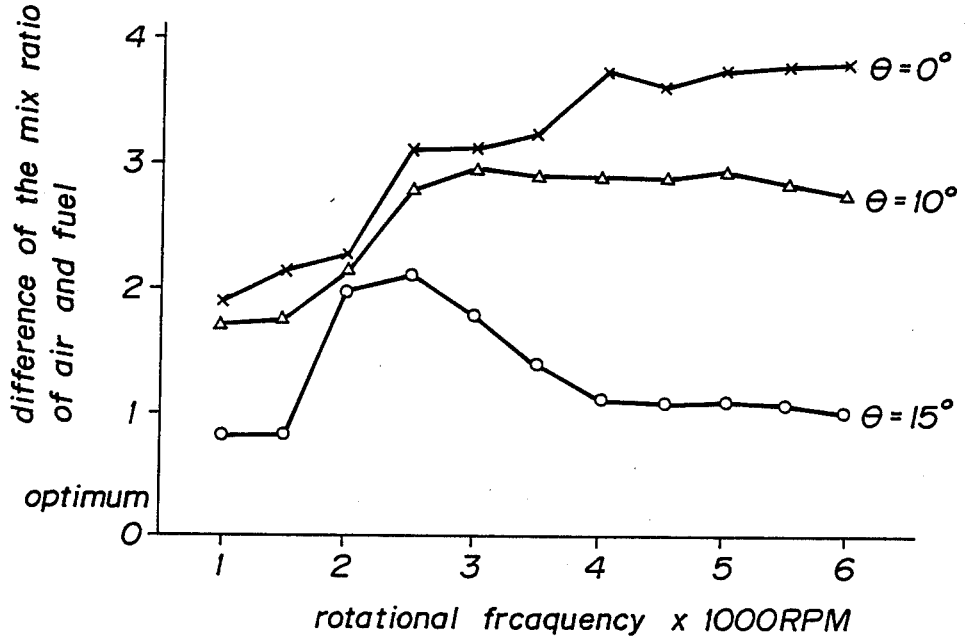

FIG. 4 is the graphical presentation of the result of rating the difference of the mix ratio of air and fuel between cylinders. Test results indicate that the mix ratio between air and fuel is optimal when the secondary barrel 10 is tilted at a tile angle $\theta$ of approximately 15°. Little difference is present when the secondary barrel 10 is tilted by 10° and 15° ($\theta=10°$ and $\theta=15°$), as demonstrated by the plots shown in FIG. 4.

As is clear from the above description, the air distribution apparatus related to the invention provides a useful mechanism in which end portions of a plurality of branched air-intake tubes are respectively connected to air-intake holes of respective cylinders of a multiple-cylinder engine whose carburetor is connected to the air-intake ports above the mounting assembly unit which is positioned in the center of these branched air-intake tubes. The apparatus disposes the primary barrel of the carburetor in perfect alignment with the transverse centerline of the assembly unit and the secondary barrel of the carburetor in a displaced position in the direction of the fuel nozzles supply tubes for implementing connection of both barrels to the assembly unit. Consequently, the apparatus can draw a more balanced flow from the fast-air-flow portion and the slow-air-flow portion of the barrels, and thus the mix ratio between air and fuel in each cylinder can be properly balanced. This promotes the engine performance. In particular, optimal mix ratio can be achieved by displacing the secondary barrel to a tilt position 15° from the centerline relative to the primary barrel. The above adjustment procedure can be inexpensively implemented at the air inlet portion of the branched air-intake tubes without adding any modification to the carburetor itself.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An air-distribution apparatus for use with an internal combustion engine wherein end portions of a plurality of branched air-intake tubes are adapted to be respectively connected to air-intake holes of respective cylinders of a multiple-cylinder engine whose carburetor is connected to a plurality of air-intake ports above an assembly unit installed substantially at the center of said plurality of branched air-intake tubes, and wherein a primary barrel of said carburetor is disposed in alignment with a transverse centerline of said assembly unit and a secondary barrel of said carburetor is disposed in a position wherein it is displaced sidewardly from the centerline in the direction of the fuel nozzles which connect to both barrels.

2. An apparatus according to claim 1, wherein a line passing through the centerlines of the primary and secondary barrels extends at an angle of about 15° relative to said centerline.

3. An apparatus according to claim 1, wherein the air-intake port associated with said secondary barrel is displaced sidewardly from said centerline so that said centerline still intersects said last-mentioned air-intake port but a substantial majority of the cross sectional area of said last-mentioned air-intake port is disposed on one side of said centerline.

4. An air-distribution apparatus for use with an internal combustion engine having at least four cylinders, said apparatus including a first air-intake tube terminating in branched end portions which respectively connect to a first and second of said cylinders, a second air-intake tube terminating in branched end portions which respectively connect to third and fourth of said cylinders, a tubular mounting unit connected substantially at the center between said first and second intake tubes to define an open flow passage therebetween, said mounting unit having a top wall provided with first and second intake ports formed therethrough each for communication with said first and second tubes, and a carburetor mounted on said mounting unit and respectively having first and second carburetor barrels which respectively communicate with said first and second intake ports, the improvement comprising:

said mounting unit defining a central vertical plane extending transversely thereacross so that flow passages from said central plane through said first tube to each of said first and second cylinders is of equal length to the flow passages from said central plane through said second tube to each of said third and fourth cylinders, said first and second barrels respectively having venturis therein containing a fuel nozzle with each fuel nozzle including a fuel supply tube which projects radially from the venturi partially across the respective barrel for connection to the respective barrel sidewall, said fuel nozzle tubes projecting sidewardly in a direction generally away from one side of said central plane, and said first and second inlet ports being sidewardly disposed generally in the direction of said central plane but laterally displaced so that the centerlines of said first and second intake ports are disposed a predetermined distance apart as measured in a direction which is substantially perpendicular to said central plane.

5. An apparatus according to claim 4, wherein said second intake port is disposed with its centerline spaced a substantial distance to one side of said central plane in the same sideward direction as said fuel supply tubes, and the centerline of said first intake port being disposed closely adjacent or within said central plane.

6. An apparatus according to claim 5, wherein a reference line which extends in perpendicular and intersecting relationship to the centerlines of said first and second barrels intersects said central plane at an angle of about 15°.

7. An apparatus according to claim 6, wherein the fuel nozzle tubes as associated with said barrels extend radially thereof in approximately perpendicular relationship to said reference line.

* * * * *